US006530392B2

(12) United States Patent
Blatter et al.

(10) Patent No.: US 6,530,392 B2
(45) Date of Patent: Mar. 11, 2003

(54) VALVE CLEANING ASSEMBLY

(75) Inventors: Ewald R. Blatter, Henrietta, NY (US); Hans C. Blatter, Rochester, NY (US); Daniel M. McBride, Rochester, NY (US); David J. Knapp, Rochester, NY (US)

(73) Assignee: Finger Lakes Chemicals, Inc., Rochester, NY (US)

( * ) Notice: Subject to any disclaimer, the term of this patent is extended or adjusted under 35 U.S.C. 154(b) by 0 days.

(21) Appl. No.: 10/055,574

(22) Filed: Jan. 23, 2002

(65) Prior Publication Data

US 2002/0117207 A1 Aug. 29, 2002

Related U.S. Application Data

(63) Continuation-in-part of application No. 09/617,154, filed on Jul. 17, 2000, now abandoned.

(51) Int. Cl.[7] ..... B08B 9/032; B08B 9/035

(52) U.S. Cl. ..... 137/240; 123/198 A; 134/102.1; 134/102.2; 134/113; 134/169 A; 137/888; 239/106; 239/112

(58) Field of Search ..... 123/198 A; 134/169 A, 134/113, 102.1, 102.2, 888; 137/240, 896, 888; 239/104, 106, 112, 113

(56) References Cited

U.S. PATENT DOCUMENTS

| | | | | |
|---|---|---|---|---|
| 4,520,773 A | * | 6/1985 | Koslow | 123/198 A |
| 4,784,170 A | | 11/1988 | Romanelli et al. | |
| 4,989,561 A | | 2/1991 | Hein et al. | |
| 5,090,377 A | | 2/1992 | Pearson | |
| 5,097,806 A | | 3/1992 | Vataru et al. | |
| 5,109,564 A | | 5/1992 | Horvath | |
| 5,257,604 A | * | 11/1993 | Vataru et al. | 123/198 A |
| 5,485,857 A | * | 1/1996 | Amundsen | 134/102.2 |
| 5,516,370 A | | 5/1996 | Karnauchow et al. | |
| 5,829,460 A | | 11/1998 | Acevedo | |
| 5,833,765 A | * | 11/1998 | Flynn et al. | 134/169 A |
| 5,970,994 A | | 10/1999 | Sasaki et al. | |
| 6,000,143 A | | 12/1999 | Oechsle | |
| 6,000,413 A | | 12/1999 | Chen | |
| 6,007,626 A | * | 12/1999 | Leendertsen | 134/169 A |
| 6,178,977 B1 | | 1/2001 | Wells | |
| 6,281,020 B1 | * | 8/2001 | Usui | 134/113 |

OTHER PUBLICATIONS

Castle's Ultimate Tune–Up, Chem Sheet, vol. 5, No. 1, Feb. 22, 1999.

* cited by examiner

*Primary Examiner*—George L. Walton
(74) *Attorney, Agent, or Firm*—Stephen B. Salai, Esq.; Donna P. Suchy, Esq.; Harter, Secrest & Emery LLP

(57) ABSTRACT

The present invention is a valve cleaning apparatus and method for transporting a cleaning fluid from a supply tank into the air intake valves of a combustion engine. It comprises housing having a pair of legs and a closed end. The housing has a flow path through the housing. A valve is located collinear with the flowpath. The valve cleaning apparatus also includes tubing, a nozzle and a hook to hang the assembly from the hood of a car.

14 Claims, 3 Drawing Sheets

VALVE CLEANING ASSEMBLY

RELATED APPLICATIONS

This application claims the benefit of U.S. application Ser. No. 09/617,154 entitled VALVE CLEANING APPARATUS, filed Jul. 17, 2000, which is a C-I-P, now abandoned.

FIELD OF THE INVENTION

The present invention relates to an adapter assembly for transporting a fluid from a supply tank into the air intake valves of a combustion engine.

BACKGROUND OF THE INVENTION

Modern unleaded gasolines, after combustion, leave deposits on various components of internal combustion engines. Evidence of these deposits may be seen by inspecting the tailpipe or opening the throttle blades and using a light to visually inspect the visible portions of the intake system. Owners must periodically have these deposits removed in order to maintain their engine's performance.

One method of removing these deposits is by adding detergent compounds to the gasoline. Generally speaking, super-unleaded fuels contain a higher concentration of this detergent additive, which may provide a reasonable job of control of undesired deposits in the intake system. To remove deposits from various parts of the engine, the detergent additives need to be sprayed on the parts that require cleaning. These fuels with detergent additives clean throttle body style fuel injection systems reasonably well. In these systems, the fuel is sprayed at the initial point of airflow into the engine, which allows detergent compounds within the fuel to maintain the intake system in a reasonably clean condition.

This is not the case with port fuel injection system engines. This type of system sprays fuel directly in the air stream just before the intake valves. As a result, the components in the intake manifold from the air intake down to the point where the fuel injectors spray the fuel are subject to formations of unwanted deposits from oil from the crank case ventilation system and exhaust gases from exhaust gas recirculation systems. These deposits contribute to form a "dirty" intake system. No matter what brand or quality of fuel is used or how often the fuel injectors are cleaned or which additives are used, they will not eliminate these deposits as the cleansing action of the detergents contained in the fuel are not applied to the components that are located upstream of the fuel injectors.

Most modern engines contain many components in the path of airflow into the engine that are affected by these deposits. These components include: intake valves, fuel injector nozzles, idle air by-pass valves, throttle plates, exhaust recirculation valves, air charged temperature sensors, knock sensors, air flow meters, turbo chargers, and safety valves. Not all of these components are present in all engines.

Deposits on these components can result in a wide variety of driveability complaints with the most common problems being unstable idle speed control and stumbling when cold.

In addition, deposits on the intake valves act like sponges and absorb fuel which degrades cold starts. Intake valve deposits also restrict airflow, reducing both low speed and high-speed performance. Current fuel additives are not completely successful in minimizing or eliminating deposits on the intake valves.

Another method of cleaning intake systems and intake valves is to partially or completely disassemble the engine. The intake manifold is removed from the engine. All components are removed from the manifold and cleaned or replaced. The intake manifold is cleaned. The head is removed from the engine. The valves are removed from the head and cleaned or replaced. The engine is then reassembled. This, of course, is time consuming and expensive.

Another method to clean the intake valves is to remove the fuel injectors, insert a sandblasting nozzle, and blast the intake valves, in place, with a blasting media such as crushed nutshells. This is not completely satisfactory because of uneven cleaning and the difficulty in removing the residue of the crushed nutshells.

SUMMARY OF THE INVENTION

An object of the invention is to provide a valve cleaning apparatus or cleaning deposits from the intake system of an internal combustion engine, without disassembling the engine.

Another object of the invention is to provide a valve cleaning apparatus which can easily and quickly be connected to the intake system of an internal combustion engine and which can facilitate the removal of deposits from all components exposed to incoming air flow including the intake valves of the engine.

Still another object of the invention is to provide a valve cleaning apparatus that can control solvent flow into the intake system of an internal combustion engine to clean the intake system of unwanted deposits.

The present invention is a valve cleaning assembly for transporting a fluid from a supply tank into the air intake valves of a combustion engine. The valve cleaning apparatus includes housing having a pair of legs and a closed end base. The housing has a flow path that extends through the housing and a zinc-coated brass needle valve to control fluid flow in the flow path. A hook is provided to attach the valve cleaning assembly from the hood of a car. The hook is connected to the housing at a hanging point that is selected to balance the assembly when connected to a half-full supply tank. The valve cleaning also includes plastic tubing and an anodized aluminum nozzle.

DETAILED DESCRIPTION OF THE INVENTION

The present invention is a valve cleaning assembly for transporting a fluid from a supply tank into the air intake valves of a combustion engine.

Figure 1:
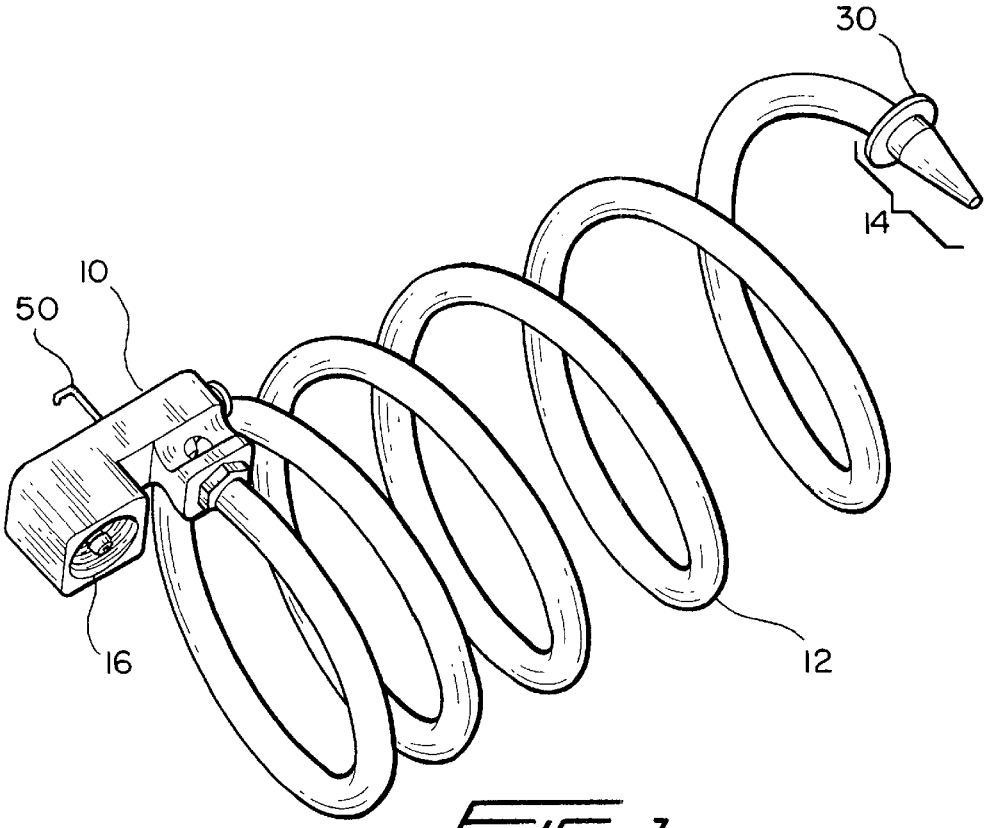
FIG. 1 is an illustration of the valve cleaning assembly of the present invention.

FIG. 1 is a view of the entire valve cleaning assembly including the housing 10, the tubing 12, and the inserted nozzle 14. The container of solvent that would be connected to the housing at 16 is not shown.

Figure 2:
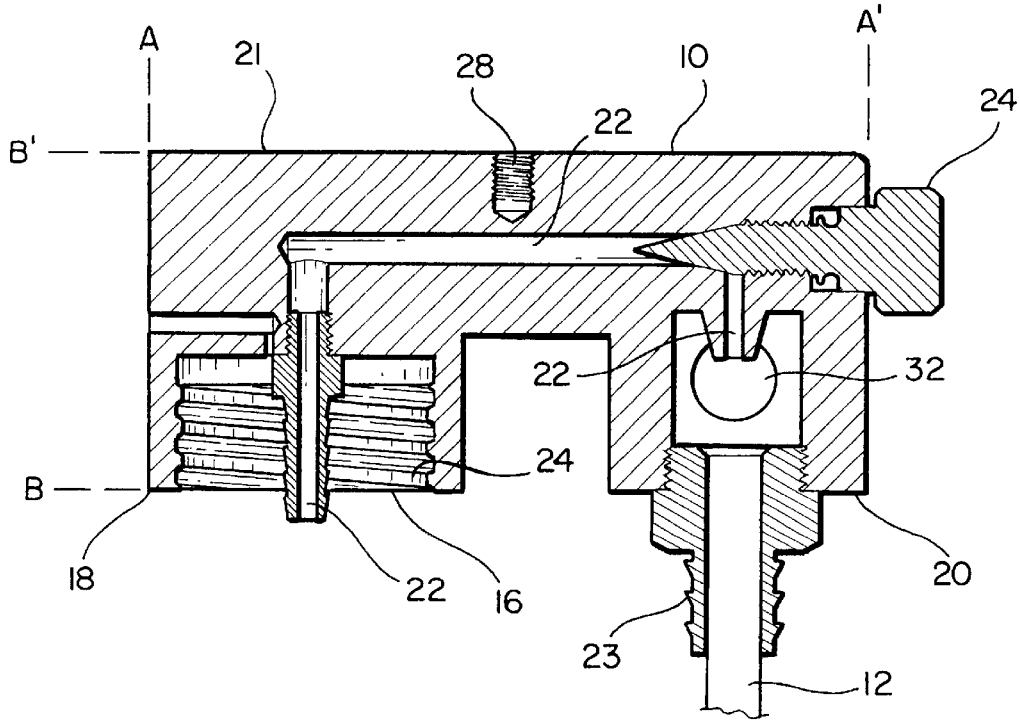
FIG. 2 is an illustration of a cross-sectional view of the housing of the present invention.

The valve cleaning assembly includes a one-piece housing 10, which is shown as a U-shaped housing in FIG. 2. Two equally long legs, a first leg 18 and a second leg 20, extend outward from a closed end member 21, also referred to as the base 21. The base of the U, measured between lines A and A', is approximately 1.7 times the length of the legs 18, 20 as measured between line B and B'. The first leg 18 where the solvent enters the housing 10 is approximately 1.25 inches in width and the second leg 20 where the solvent exits the housing 10 into the air intake system, is approximately 1 inch in width. The first leg 18 is wider than the second leg 20 primarily to accommodate the solvent container (not shown).

The housing 10 is machined from blocks of aluminum, or a similar material. After the housing is fully machined, it is anodized. Previously, the housings were made from brass but it was found that the brass housings can react with a chemical solvent being pumped through it and a discolored substance builds up where the solvent contacts the housing. The substance build-up restricts the flow of the solvent through the housing, requiring frequent periodic cleaning. The anodized aluminum does not react with the solvent and is able to be used for longer periods without cleaning.

Aluminum is also much lighter than brass. This is advantageous because the housings are hung from the interior of the hood of the car. A lighter housing is less likely to cause wear on the hood or serious damage to an engine and other items if it falls.

A flow path 22 is formed in the housing 10 creating a conduit through which the chemical solvent is introduced to the air intake hose 12 and air intake valves of the combustion engine. The flow path 22 begins at the end of the first leg 18. This leg also has threads 24 surrounding the flow path and extending inwards towards the closed end base 21 a distance between 0.4 and 0.5 inches. The threads define the opening 16 of FIG. 1. These threads are sized to fit a bottle or other container of solvent with a threaded top opening. The solvent enters the housing through the opening 16.

The flow path 22 continues through the closed end base 21 and continues around and extends outwards through the middle of the second leg 20. The flow path 22 ends at the end of the second leg 20, where the plastic tubing 12 begins.

Figure 3:
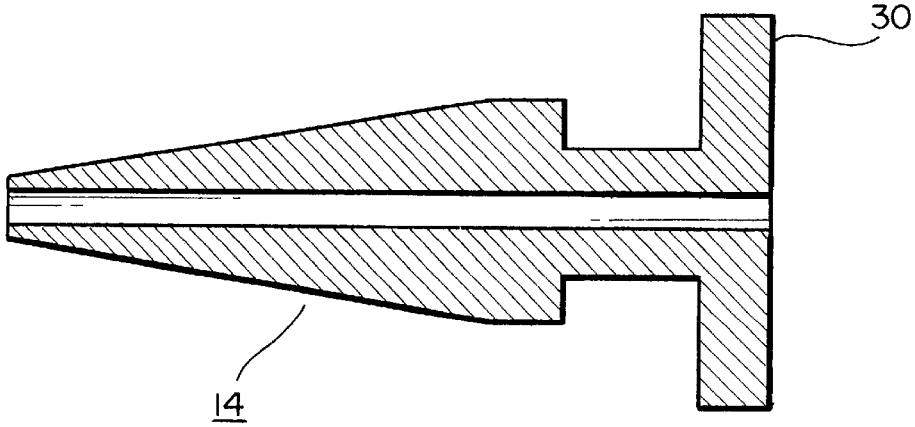
FIG. 3 is an illustration of a cross-sectional view of the anodized nozzle of the present invention.

The plastic tubing 12 is attached to the second leg, also referred to as the exit leg 20 of the housing 10. The tubing 12 is one-quarter inch reinforced clear rated PVC hose in this embodiment. It is attached with plastic clips 23 or a similar attachment device. It is sized to fit within the air intake system of an automobile. At the end of the tubing, the anodized aluminum nozzle 14 is attached. A cross-sectional view of the nozzle 14 can be seen clearly in FIG. 3. The nozzle 14 is all one piece and incorporates a sealing ring 30. The nozzle 14 has an interior diameter of approximately one tenth of an inch.

A clear acrylic sight glass 32 is also included in the housing 10 shown in FIG. 2. The clear tubing 12 and the sight glass 30 help a technician using the valve cleaning apparatus properly gauge the flow of solvent through the housing 10 and adjust the flow accordingly.

When the engine is running, the pressure inside the air intake line is reduced. This pressure decrease causes the solvent to be blown through the housing 10 along the flow path 22, into the tube 12, and out the nozzle 14 to react with the carbon buildup in the air intake valves of a combustion engine.

Figure 4A:
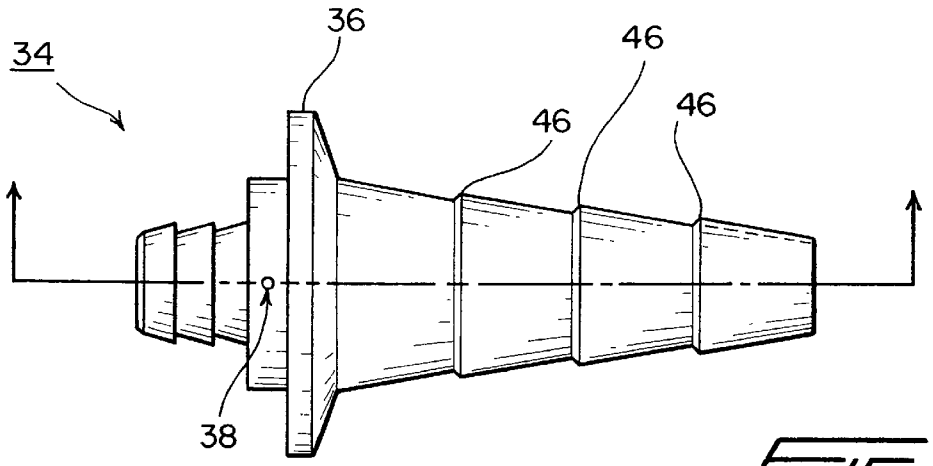
FIG. 4 is an illustration of the threaded valve of the present invention.
Figure 4B:
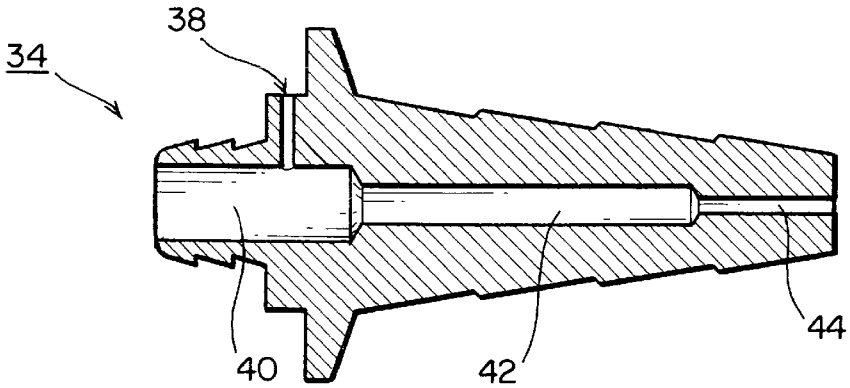

FIG. 4A shows a preferred embodiment of a one-piece nozzle 34 which includes a sealing ring 36 and a small diameter hole 38 drilled into a shoulder of the anodized aluminum nozzle 34 at a 90 degree angle to the flow path through the nozzle 34. The nozzle 34 has a three part flow path as shown in the nozzle cross-section seen in FIG. 4B. The first part 40 of the flow path has a larger diameter than the second part 42 of the flow path, which in turn has a larger internal diameter than the third part 44 of the flow path. The three flow path parts could be constructed to continuously graduate from one to the next making the flow path continually graduated from a larger preferred diameter of 9/100ths to the smallest diameter of 3/100ths. This graduation, whether in three distinct parts or continuously slows down the cleaning product as it flows through the nozzle and before it enters the engine. The exterior of the nozzle 34 also has gripping barbs 46 incorporated into the body of the nozzle at the tapered end. The barbs 46 help secure the valve cleaning apparatus to an attachment such as various vacuum lines.

The nozzle 34 uses the hole 38 to introduce air into the cleaning product flow stream through the nozzle 34. This air mixes with the cleaning product and effectively atomizes the cleaning product as it enters the vacuum induction line. This improves combustion of the cleaning product entering the air intake stream and thus results in a more effective valve cleaning apparatus.

The nozzle hole 38 and tapered interior flow diameter help reduce the risk of an engine hydro locking or seizing during a cleaning operation. The air hole 38 and the tapered interior diameter also reduce vehicle misfires during the valve cleaning operation, which can cause a check light to be set by the fuel management computer.

Figure 5:
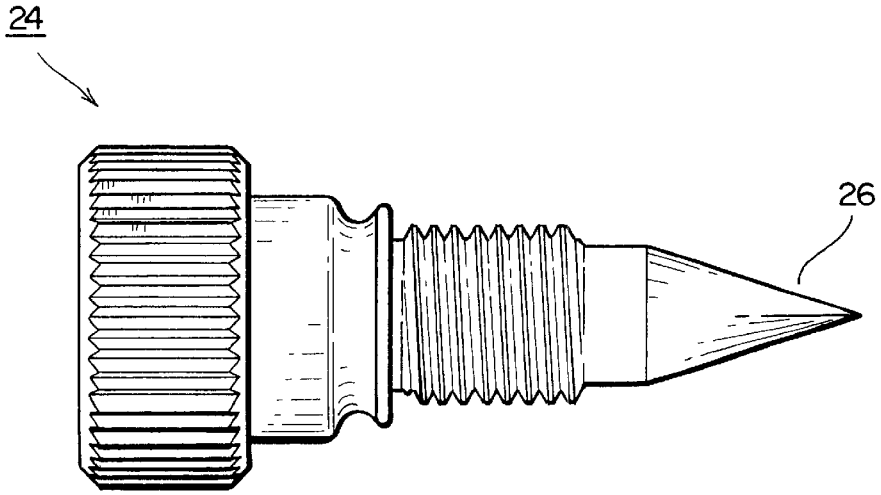
FIG. 5 is an illustration of an n embodiment of the threaded valve of the present invention.

As shown in FIG. 2, a valve 24 is used to control the rate of flow of solvent into the engine. FIG. 5 shows a side view of an embodiment of the valve 24. The valve 24 is made of copper dca360 brass. The exterior of the valve 24 is zinc-coated. This keeps the solvent from interacting with the zinc and helps prevent the buildup of reactants in the flow path. The valve 24 has a needle-shaped tip 26 and is threaded. The end of the valve opposite the tip 26 extends outward through the exterior side of the housing 10. The valve 24 is collinear with the middle portion of the flow path 22. As the valve 24 is rotated, the valve 24 opens gradually and fluid is allowed to flow from the closed end into the last portion of the flow path located in the second leg 20 and on into the plastic tubing 12.

In the base 21 of the closed end of the housing 10, a threaded opening 28 is included as shown in FIG. 2. The location of the opening 28 is directly above the center of mass of the housing 10. This location is calculated such that the mass of the housing, the tubing and a half full solvent container are balanced when the housing is hung from the interior of a hood of a car.

A hook 50, L-shaped in this embodiment, is shown on FIG. 1 is screwed into the threaded opening 28. It is used to hang the entire assembly from the interior of the hood of a car.

A user would first hang the housing from an elevated area inside the hood. He or she would then screw the bottle or canister of solvent into the threaded leg of the housing. The coiled plastic tube would be extended into the air intake tube and the valve would be rotated slowly until the chemical solvent would exits the tip at a desired rate. The solvent reacts with carbon that has coated the interior of the intake line and the intake valves and dissolves it. The dissolved carbon/chemical mixture is blown through the rest of the combustion process while the engine runs normally.

The valve 24 remains shut while the valve cleaning apparatus is setup and the tubing 12 is snaked into the intake system. After the valve cleaning apparatus is in place and the engine is turned on, the valve 24 is opened to let a steady drip of solvent flow into the intake area.

While the invention has been described in connection with preferred embodiments, it is not intended to limit the scope of the invention to the particular forms set forth, but on the contrary, it is intended to cover such alternatives, modifications, and equivalents as may be included within the spirit and scope of the invention as defined by the appended claims.

What is claimed:

1. A valve cleaning apparatus for transporting a fluid from a supply tank into air intake valves of a combustion engine for cleaning the valves, comprising:

a. A portable integral aluminum U-shaped housing having a pair of legs and a closed end, the housing further having a flow path extending from a terminal end of a first leg through the housing to a terminal end of a second leg, the flow path comprising:
   i. a first leg section extending into the first leg;
   ii. a second leg section extending into the second leg; and
   iii. an interconnecting section in the closed end of the housing interconnecting the first leg section and the second leg section;

b. a needle valve co-linear with the interconnecting section and extended into the interconnecting section in fluid communication with the fluid path for controlling fluid into the second leg section, and a portion of the needle valve extending from an exterior of the housing;

c. a nozzle in fluid communication with the second leg section;

d. a length of tubing fluidly connecting the nozzle and the second leg section; and e. a fitting for engaging the housing to allow the valve cleaning apparatus to be in balance when hung from a point above the nozzle.

2. The valve cleaning apparatus of claim 1, where the housing further comprises threads at a terminal end of the first leg for attaching a solvent container.

3. The valve cleaning apparatus of claim 2, where the tubing is coiled.

4. The valve cleaning apparatus of claim 3, where the second leg of the housing further comprises a section of clear glass through which the flow path may be seen from a viewpoint exterior to the housing.

5. A valve cleaning apparatus for transporting a fluid from a supply tank into air intake valves of a combustion engine for cleaning the valves, comprising:

a. a portable integral aluminum U-shaped housing having a pair of legs and a closed end, the housing further having a flow path extending from a terminal end of a first leg through the housing to a terminal end of a second leg, the flow path comprising:
   i. a first leg section extending into the first leg;
   ii. a second leg section extending into the second leg; and an interconnecting section in the closed end of the housing interconnecting the first leg section and the second leg section;

b. a needle valve co-linear with the interconnecting section and extended into the interconnecting section in fluid communication with the fluid path for controlling fluid into the second leg section, and a portion of the needle valve extending from an exterior of the housing;

c. a in fluid communication with the second leg section:
   i. a body defining a central cavity defining a nozzle flow path and having a shoulder with a sealing ring and a tip;
   ii. an opening drilled into the shoulder of the nozzle at a 90 degree angle to the nozzle flow path;

d. a length of tubing fluidly connecting the nozzle and the second leg section; and e. a fitting for engaging the housing to allow the valve cleaning apparatus to be in balance when hung from a point above the nozzle.

6. The valve cleaning apparatus of claim 5, where the housing further comprises threads on the first leg for attaching a solvent container.

7. The valve cleaning apparatus of claim 6, wherein the nozzle central cavity has a greater diameter at the shoulder than at the tip.

8. The valve cleaning apparatus of claim 7, wherein the diameter of the central cavity at the tip is approximately 0.003 inches and the diameter of the central cavity at the shoulder is 0.009 inches.

9. The valve cleaning apparatus of claim 7, wherein the nozzle central cavity has one or more sections such that the section near the nozzle tip is the lowest diameter section.

10. The valve cleaning apparatus of claim 7, wherein the nozzle further comprises a gripping section adjacent the sealing ring.

11. The valve cleaning apparatus of claim 7, wherein the nozzle further comprises a gripping section adjacent the tip.

12. The valve cleaning apparatus of claim 7, wherein the nozzle tip further comprises an outer edge adjacent the opening that is cambered.

13. The valve cleaning apparatus of claim 6, where the tubing is coiled.

14. The valve cleaning apparatus of claim 7, where the second leg of the housing further comprises a section of clear glass through which the flow path may be seen from a viewpoint exterior to the housing.

* * * * *